United States Patent [19]

Anderson

[11] Patent Number: 4,911,486

[45] Date of Patent: Mar. 27, 1990

[54] TAMPER PROOF SLIDE BOLT LOCKING APPARATUS

[75] Inventor: John P. Anderson, Norco, Calif.

[73] Assignee: The Hartwell Corporation, Placentia, Calif.

[21] Appl. No.: 393,551

[22] Filed: Aug. 14, 1989

[51] Int. Cl.[4] ..... E05C 1/04

[52] U.S. Cl. ..... 292/148; 70/54

[58] Field of Search ..... 292/148, 156, 162, 244, 292/59, 68, 281, 57; 70/54, 56, 2, 3

[56] References Cited

U.S. PATENT DOCUMENTS

| | | | |
|---|---|---|---|
| 1,690,041 | 6/1925 | Sundquist | 70/38 A |
| 3,572,062 | 3/1971 | Beebe | 70/1.5 |
| 3,953,062 | 4/1976 | Maston | 292/57 |
| 4,031,719 | 6/1977 | Klinger et al. | 70/56 |
| 4,033,155 | 7/1977 | DeLucia | 70/56 |
| 4,068,505 | 1/1978 | Yolk, Jr. | 70/56 |
| 4,095,828 | 6/1978 | East | 292/148 |
| 4,113,291 | 9/1978 | Cameron | 292/40 |
| 4,125,281 | 11/1978 | Dean et al. | 292/148 |
| 4,229,956 | 10/1980 | Thorburn | 70/129 |
| 4,238,941 | 12/1980 | Halopoff | 292/56 |
| 4,307,904 | 12/1981 | Daus | 292/148 |
| 4,437,692 | 3/1984 | Halopoff . | |
| 4,655,487 | 4/1987 | Korn et al. | 292/57 |
| 4,690,441 | 9/1987 | Fazzolari et al. | 292/57 |
| 4,745,783 | 5/1988 | Poe | 70/2 |
| 4,782,675 | 11/1988 | Thorburn | 292/148 X |
| 4,788,836 | 12/1988 | Poe | 70/2 |

FOREIGN PATENT DOCUMENTS

| | | |
|---|---|---|
| 77001/81 | 6/1982 | Australia . |

*Primary Examiner*—Richard E. Moore

*Attorney, Agent, or Firm*—Fulwider, Patton, Lee & Utecht

[57] ABSTRACT

A tamper proof slide bolt locking apparatus having a mounting plate which mounts a slide bolt. The plate is attachable to movable structure such as a garage door, and a portion extends outwardly from the door. A hasp fixed to the slide bolt extends downwardly and then outwardly from the door in overlying relation to the outwardly extending portion of the plate. The outwardly extending portions of the plate and hasp include shackle openings for locking them against relative movement. The front margins of the plate and hasp are downwardly and upwardly directed, respectively, to overlie and protect vulnerable portions of the padlock shackle.

11 Claims, 1 Drawing Sheet

TAMPER PROOF SLIDE BOLT LOCKING APPARATUS

BACKGROUND OF THE INVENTION

1. Field of the Invention

The present invention relates to a tamper proof slide bolt locking apparatus which provides protection for an associated padlock shackle.

2. Description of the Prior Art

A common apparatus for locking a movable structure such as a garage door against movement relative to a fixed structure such as a door frame employs a slide bolt attached to the door and slidable into a receptacle in the door frame. Preferably the apparatus is adapted for mounting at either side of the door for operation in either a left or right hand mode, that is, slidable to the left into a door frame located to the left of the door, or slidable to the right into a door frame located to the right of the door.

The typical slide bolt is bent or deformed to provide a central loop adapted to overlie an apertured staple attached to the door. The staple receives a padlock shackle to prevent the loop from being lifted off the staple, which is necessary for sliding the bolt back and forth. In this arrangement the padlock shackle is undesirably exposed to bolt cutters and the upper surface of the lock body can be struck with a hammer to forcibly dislodge the shackle.

One solution to the problem of such tampering is use of higher grade steel and heavier cross sections for the shackle, hasp and staple components, but this adds considerable expense to the locking system. Even such strengthened components are vulnerable to modern bolt cutters.

One type of locking device proposed in the prior art to deter such tampering employs a specially designed protective cover. The cover is either welded to or pivotally carried by the slide bolt. Separate hasp plates are welded to the cover and to the slide bolt mounting plate so they can be locked together by the padlock shackle. U.S. Pat. Nos. 4,031,719 (Klinger et al) and 3,953,062 (Maston) disclose devices of this type. Unfortunately, such specially formed and configured covers greatly increase fabrication costs, and make placement and removal of the padlock difficult. Typically the size of the space behind the cover for receiving the padlock is minimized to thwart insertion of bolt cutters. Consequently, user insertion of the padlock is awkward. The cover covers the shackle receiving openings and therefore makes location of the shackle in the openings difficult. Finally, although the cover provides protection against bolt cutters, it is susceptible to insertion of prybars and the like.

SUMMARY OF THE INVENTION

A tamper proof slide bolt locking apparatus according to the present invention can be fitted to movable structures such as garage doors for operation of the slide bolt in either a left hand or a right hand mode.

A unitary mounting plate combines the functions of mounting the apparatus to the door, slidably carrying the slide bolt, providing one set of shackle receiving openings, and overlying and protecting portions of the shackle and padlock body.

A unitary hasp is fixed to the slide bolt and includes a complementary set of shackle openings alignable with the plate shackle openings to receive the shackle. The hasp shrouds and protects the upper portion of the shackle so that in combination with the mounting plate the shackle and upper lock body are protected from cutting by burglar tools, and the upper portion of the lock body is protected from hammer blows and the like. The sets of shackle openings are clearly visible to facilitate placement and removal of the padlock shackle.

The apparatus can be used with padlocks of conventional size and configuration. The lower end of the lock body is always uncovered and readily accessible. The apparatus occupies a relatively small mounting area and does not have any protuberances or projections which might pose a risk of injury to users.

In one specific embodiment the present apparatus includes a mounting plate having rear and front portions joined by an intermediate portion which includes the first set of shackle openings. The rear portion is attachable to the movable structure and includes spaced apart support flanges or mounting ears to slidably carry the slide bolt.

This embodiment includes a slide bolt assembly comprising the slide bolt, and also a hasp having a rear portion fixed or unitary with the bolt. The hasp also comprises a front portion, and an intermediate portion which joins the front and rear portions and which also includes the second set of shackle openings. Operation in either a right or left hand mode can be accommodated.

The hasp intermediate portion overlies the plate intermediate portion so that the two sets of shackle openings are alignable for receiving the padlock shackle. The plate and hasp front portions cooperate to protect the lock and shackle, the plate front portion being downwardly turned in front of the upper portion of the padlock body and the lower portion of the shackle, and the hasp front being upwardly turned in front of the upper portion of the shackle. The hasp front portion is also inwardly or rearwardly formed to provide a protective flange or lip above the shackle.

The cost and complexity of fabrication and assembly of the apparatus is greatly reduced because the mounting plate and hasp are each formed in one integral piece out of sheet or plate stock which is punched or drilled to provide the shackle openings.

Other aspects and advantages of the present invention will become apparent from the following more detailed description taken in conjunction with the accompanying drawings.

DESCRIPTION OF THE PREFERRED EMBODIMENT

Figure 1:
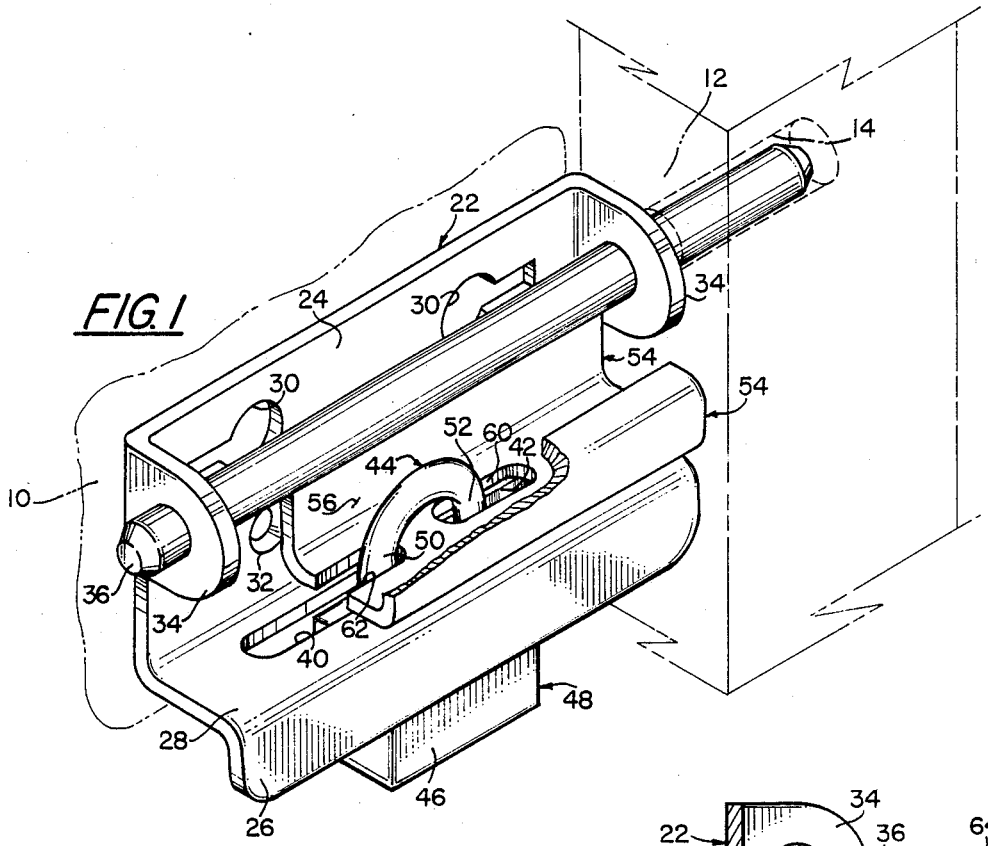
FIG. 1 is a perspective view of a tamper proof locking apparatus according to the present invention, the fixed structure with which it is associated being indicated in phantom outline.

Referring now to the drawings, the present tamper proof slide bolt locking apparatus is shown as it would appear when mounted to the right side of a garage door 10 adjacent a door frame 12. The door frame 12 includes an elongated slide bolt receptacle 14 for receiving the elongated slide bolt 36 of the apparatus.

In the prior art, as previously indicated, the slide bolt included a central bend or loop (not shown) which served as a hasp which could be pivoted to overlie a U-shape hasp staple (not shown) attached to the door. Such an installation was vulnerable to tampering by thieves. The hasp loop could be cut by a hacksaw, and it offered a point of leverage for a prybar, enabling a thief to pry off the hasp staple and move the slide bolt from its door frame receptacle.

The present apparatus is uniquely suited to lock the door 10 to the door frame 12 in either a left or right hand mode of operation. It employs only two unitary components, one of which is attached to a slide bolt 36. The components are formed out of sheet or plate material punched or cut to provide the necessary shackle receiving openings. The nature and thickness of the material is selected to provide high resistance to cutting by bolt cutters, hacksaws, chisels, or the like.

One component constitutes a mounting plate 22 having a flat, substantially vertically oriented rear portion 24, a substantially vertically oriented front portion defining a depending protective lip or cover 26, and a substantially horizontally oriented intermediate portion 28 which integrally joins the front and rear portions.

The rear portion 24 is adapted for attachment to the garage door 10 and includes a pair of upper fastener openings 30 for receiving suitable fasteners (not shown) to fixedly attach the plate to the door. An additional pair of fastener openings 32 are located below the openings 30. They are shown as countersunk to receive heavy screw fasteners (not shown), but they could be made rectangular for receiving carriage bolts. The form of the fastener openings and the particular form of fastener employed are matters of choice and will vary according to the needs of the particular application, as will be apparent.

The ends of the rear portion 24 are outwardly or forwardly formed to provide support ears or flanges 34. These include aligned slide bolt openings for longitudinally slidably receiving the elongated slide bolt 36. As will be seen, the bolt 36 forms part of a slide bolt assembly 38.

The plate intermediate portion 28 includes adjacent elongated slots or shackle openings 40 and 42 which, as will be seen, can be either slightly narrower or wider than the outside width of a padlock shackle 44.

The shackle 44 is part of a conventional padlock 48 having a generally rectangular lock body 46 of inverted U-shape. The shackle 44 is defined by a pair of legs 18 and 20. These are sometimes termed "pivot" and "capture" legs. In an unlocked state the lock body extends away from the capture leg. Tilting of the lock body 16 then permits the capture leg 20 to be more easily manipulated through the shackle openings 40 and 42 when they are made narrower. If the openings 40 and 42 are made wider, the full width of the shackle can pass through the opening without tilting the lock body.

Figure 2A:
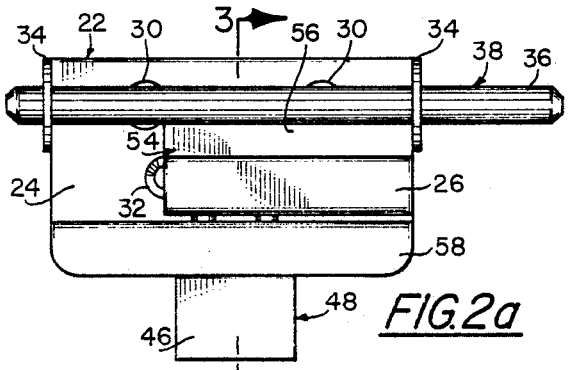
FIG 2*a* is a view similar to FIG. 2, but illustrating the apparatus in locking position for a left hand mode of operation.
Figure 2B:
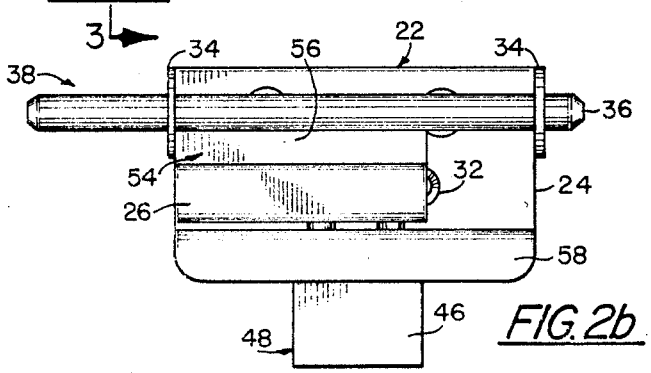
FIG 2 is a front elevational view of the apparatus of FIG. 1 in its locking position for a right hand mode of operation.

In the position of the padlock 48 illustrated in FIGS. 1 and 2, which is a left hand mode of operation, the pivot leg 50 of the shackle is disposed within the shackle opening 40 and the capture leg 52 is disposed within the shackle opening 42. This orientation is reversed for a right hand mode of operation, as seen in FIG. 2*a*.

Figure 3:
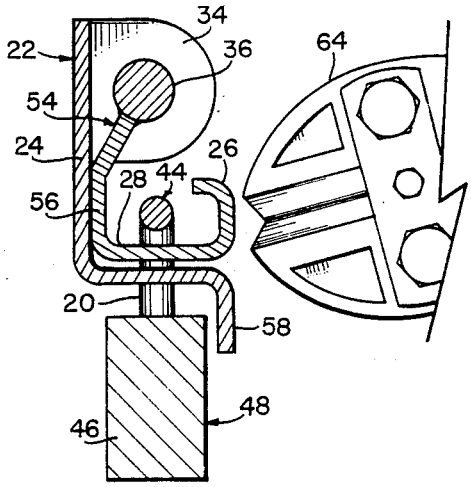
FIG. 3 an enlarged view taken along the line 3—3 of FIG. 2, and showing a portion of a typical set of bolt cutters.

In addition to the slide bolt 36, the assembly 48 includes the other unitary component, that is, the hasp 54. The hasp comprises a rear portion 56 whose upper extremity, as best seen in FIG. 3, is attached by welding or the like to the slide bolt 36. From there the rear portion 56 angles downwardly and rearwardly into close relation with the plate rear portion 24. The rear portion then extends substantially vertically downwardly across the lower fastener openings 32. It is noted that the slide bolt 36 overlies the upper fastener openings 30 so that both sets of fasteners are shielded against removal in the locked state of the present apparatus.

The hasp 54 further comprises a front portion which is substantially vertically and upwardly directed, and thereafter rearwardly turned or deformed to provide a protective lip, flange or cover 58. In addition, the hasp includes an elongated, centrally located shackle or capture leg opening 60 and a pair of laterally or outwardly opening pivot leg slots or openings 62, only one of which is seen in FIG. 1.

Pivot leg 50 is located in the leftmost opening 62 in the right hand mode of operation illustrated in FIG. 1, but would be located in the rightmost opening in the left hand mode of operation seen in FIG. 2*a*.

In order to receive the padlock shackle, the intermediate portions of plate 22 and hasp 54 are located closely adjacent and in confronting relation, as seen in FIG. 3, with their complemental shackle openings in alignment. Also, in this position the plate cover 26 covers the upper portion of the shackle, and the hasp cover 58 covers the lower portion of the shackle and the upper portion of the lock body. Bolt cutters 64 are partially shown in FIG. 3 to illustrate the inability of such a cutter to reach the covered shackle.

The shackle openings are clearly visible to enable easy placement of the shackle. Thus, to lock the garage door in place the hasp 54 and the associated slide bolt 36 are moved to the right to seat the bolt extremity within the bolt receptacle 14. The hasp is then pivoted downwardly about the longitudinal axis of the bolt 36 to bring the intermediate portions of the mounting plate and hasp into close relation. In this position the plate shackle opening 40 underlies the leftmost hasp pivot leg opening 62, and the other shackle opening 42 in the plate underlies the elongated central capture leg opening 60 of the hasp.

The unlocked padlock is tipped or cocked to the left to enable easy insertion of the capture leg 52 through the shackle opening 40. The shackle is then moved to the right until the capture leg 52 overlies the capture leg opening 60 and the plate shackle opening 42. Closure of the shackle then projects the capture leg through these openings into the lock body 46. Unlocking is the reverse of this procedure.

Where the present apparatus is associated with a door frame located on the opposite or left side of the door, the locking position will be as illustrated in FIG. 2*a*. In this position the hasp capture leg opening 60 will be aligned with the mounting plate shackle opening 40 to receive the capture leg 52, while the pivot leg 50 will extend through the other shackle opening 42 and within the rightmost pivot leg opening 62.

In the foregoing description references to "upper", "lower", "vertical", "horizontal", "right", "left", "front", "back", etc. are with reference to the orientation of the apparatus as seen in FIG. 1. Obviously the interpretation of these reference terms would be modified if the apparatus were differently oriented. The claims which follow are to be interpreted accordingly.

From the foregoing is will be appreciated that the present tamper proof locking apparatus uniquely provides an economical and inexpensive way to restrict unauthorized access to the padlock shackle. The apparatus is relatively compact, convenient to install, permits use of a conventional padlock, and can be fitted to garage doors and similar structures without any need for special modifications of such structures.

In its locked state the lock body 46 is constrained against any movement other than movement away from its shackle during unlocking, and the shackle constrains the hasp against both rotational and translational movement.

The space between the door and the depending plate cover 58 closely approximates the thickness of the lock body so there is little room for insertion of burglar tools. Likewise, the close fitting relation between the intermediate portions of the mounting plate and cover and the close relation of the hasp cover to the slide bolt make it virtually impossible to insert burglar tools.

The material of the components of the apparatus and their thickness can be selected to suit the particular application at hand, the object being to make the dimensions of the apparatus such that they complement the dimensions of the particular padlock being used.

Various modifications and changes may be made with regard to the foregoing detailed description without departing from the spirit of the invention.

What is claimed is:

1. A tamper proof slide bolt locking apparatus for locking a movable structure against movement relative to a fixed structure, the apparatus comprising:

a mounting plate including a rear portion, a front portion and an intermediate portion joining the front and rear portions, the rear portion being adapted for attachment to the movable structure and including support flanges having aligned slide bolt openings, the front portion defining a downwardly formed cover, and the intermediate portion having a shackle opening; and a slide bolt assembly including an elongated slide bolt having its opposite extremities axially slidably disposed through the slide bolt openings for slidable movement into and out of engagement with the fixed structure, the slide bolt assembly further including a hasp having a rear portion attached to the bolt, a front portion defining an upwardly turned cover, and an intermediate portion joining the front and rear portions of the hasp and including a shackle opening, the intermediate portions of the plate and hasp being located in confronting relation for alignment of the shackle openings of the plate and hasp to receive a padlock shackle, the plate and hasp covers being oriented to lie in front of the shackle to protect it from tampering.

2. A tamper proof slide bolt locking apparatus according to claim 1 wherein the rear portion of the mounting plate and the lower rear portion of the hasp are substantially vertically oriented, the intermediate portions are substantially horizontally oriented, and the front portions are substantially vertically oriented.

3. A tamper proof slide bolt locking apparatus according to claim 1 wherein the extremities of the slide bolt are projectable beyond the support flanges, respectively, for left or right hand engagement with the fixed structure, and wherein the side margins of the hasp rear portion are engageable with the support flanges, respectively, to limit the extent of projection for such left hand engagement and right hand engagement, respectively.

4. A tamper proof slide bolt locking apparatus according to claim 1 wherein the apparatus is adapted to cooperate with a padlock characterized by a padlock shackle having a capture leg and a pivot leg, and wherein the shackle opening in the mounting plate intermediate portion is elongated for accepting the capture leg to permit lateral movement of the capture leg toward the shackle opening in the hasp intermediate portion for receipt therein.

5. A tamper proof slide bolt locking apparatus according to claim 1 wherein the side margins of the hasp intermediate portion include a pair of laterally open slots for selectively receiving the pivot leg of the shackle.

6. A tamper proof slide bolt locking apparatus for use in combination with a padlock having a pivot leg and a capture leg defining a shackle of inverted U-shape, wherein the apparatus is operative to lock a movable structure against movement relative to a fixed structure, and is selectively operative in a left hand mode to lock the movable structure against movement relative to a fixed structure located to the left of the movable structure, or in a right hand mode to lock the movable structure against movement relative to a fixed structure located to the right of the movable structure, the apparatus comprising:

a mounting plate including a rear portion, a front portion and an intermediate portion joining the front and rear portions, the rear portion being adapted for attachment to the movable structure and including support flanges having aligned slide bolt openings, the front portion defining a downwardly directed cover, and the intermediate portion having adjacent, elongated shackle leg openings each long enough to receive both the capture and pivot legs; and a slide bolt assembly including an elongated slide bolt having its opposite extremities longitudinally slidably disposed through the slide bolt openings for slidable movement to the left in the left hand mode, and to the right in the right hand mode, into and out of engagement with the fixed structure, the slide bolt assembly further including a hasp having a rear portion attached to the bolt, a front portion defining an upwardly directed cover, and an intermediate portion having end margins and joining the front and rear portions of the hasp, the intermediate portion including a central capture leg opening and adjacent, laterally open pivot leg openings in its side margins, respectively, the intermediate portions of the plate and hasp being located in confronting relation for alignment of one of the shackle leg openings of the plate with the capture leg opening in the hasp, the plate and hasp covers being oriented to lie in front of the shackle to protect it from tampering.

7. A tamper proof slide bolt locking apparatus according to claim 6 wherein the rear portion of the mounting plate and the lower rear portion of the hasp are substantially vertically oriented, the intermediate portions are substantially horizontally oriented, and the front portions are substantially vertically oriented.

8. A tamper proof slide bolt locking apparatus according to claim 7 wherein the upper extremity of the hasp front portion is rearwardly directed to form a protective flange.

9. A tamper proof slide bolt locking apparatus according to claim 6 wherein the side margins of the hasp rear portion are engageable with the support flanges, respectively, in the left and right hand modes.

10. A tamper proof slide bolt locking apparatus according to claim 6 wherein the mounting plate rear portion includes fastener openings for receiving fasteners to attach the rear portion to the movable structure, and wherein the hasp rear portion overlies the fastener openings.

11. A tamper proof slide bolt locking apparatus according to claim 10 wherein the mounting plate rear portion includes additional fastener openings for receiving additional fasteners to attach the rear portion to the movable structure, and wherein the slide bolt overlies the additional fastener openings.

* * * * *